US005664640A

United States Patent [19]

Smith

[11] Patent Number: 5,664,640

[45] Date of Patent: Sep. 9, 1997

[54] ASCENDING CAM

[76] Inventor: Daniel I. Smith, 2187 Hastings Ct., Santa Rosa, Calif. 95405

[21] Appl. No.: 383,195

[22] Filed: Feb. 3, 1995

[51] Int. Cl.[6] ..... A62B 1/14; B65H 59/16

[52] U.S. Cl. ..... 182/5; 182/193

[58] Field of Search ..... 182/5, 191, 192, 182/193

[56] References Cited

U.S. PATENT DOCUMENTS

| | | | |
|---|---|---|---|
| 3,852,943 | 12/1974 | Healy | 182/5 X |
| 3,946,989 | 3/1976 | Tsuda | 182/5 X |
| 4,034,828 | 7/1977 | Rose et al. | 182/5 |
| 4,253,218 | 3/1981 | Gibbs | 182/5 X |
| 4,502,668 | 3/1985 | Dodge, Jr. | 182/5 X |
| 4,560,029 | 12/1985 | Dalmaso | 182/5 |
| 4,657,110 | 4/1987 | Wolner | 182/5 |
| 4,881,622 | 11/1989 | Machal | 182/5 X |
| 5,265,696 | 11/1993 | Casebolt | 182/192 X |
| 5,316,103 | 5/1994 | Bell et al. | 182/192 X |

FOREIGN PATENT DOCUMENTS

| | | | |
|---|---|---|---|
| 2417988 | 10/1979 | France | 182/5 |
| 2422587 | 12/1979 | France | 182/5 |
| 2671489 | 7/1992 | France | 182/5 |

OTHER PUBLICATIONS

Ascender catalog #ULTAS02, pp. 3, 4, and 5. (date unknown).

*Primary Examiner*—Terry Lee Melius
*Assistant Examiner*—Christopher J. Novosad
*Attorney, Agent, or Firm*—Rick Martin

[57] ABSTRACT

An improved cam for use in a rope gripping device features a concave cam working surface. Gear-like teeth, each having a flat top are placed perpendicular to the rope inside the concave cam working surface. The cutting force is reduced, and the grip strength is increased. An integral safety lock can be set in either the open or closed position.

12 Claims, 2 Drawing Sheets

ASCENDING CAM

FIELD OF INVENTION

The present invention relates to ascending rope devices, pulley safety locks, fall protection devices, and the like.

BACKGROUND OF THE INVENTION

Ascenders are mechanical devices which will allow a rope or the like to move in only one direction. Ascenders are used in a wide range of applications such as personal fall protection, in rock climbing using the rope for an ascending maneuver, hauling systems, pulley safety locks, and rope cleats. Ascenders will grip on any type of rope—kernmantle, twisted, braided, or plated.

Two basic types of ascenders are generally known. They are first a toothed cam type. Commercial manufactures of the toothed cam type include Jumar, CMI, and Petzl. These devices have slanted spike-like teeth. They are the most common type of ascender found in ascending systems. These devices usually can be put on or off the rope with one hand. One drawback is the tendency for mud or ice to clog the teeth. Once the teeth are clogged, the device fails. Most toothed style ascenders are right and left handed, and as a rule are sold in pairs.

A second basic type of ascender is a ridged cam. They have fewer, but larger, rounded ridges perpendicular to the direction of travel. No concavity of the bite surface is used. A pair of these are often used on sailboats. This simple, yet elegant design, presses or squeezes the rope with ridges instead of spike teeth. This design grabs wet, icy, or muddy ropes more securely than will a toothed cam, however, this will be at the expense of rope damage. Most ridged cam ascenders require two hands to put on or off the rope. Two commercial brands are Gibbs and Rock Exotica ascenders.

Both the toothed and ridged cam types use a concave working surface which engages the rope. Such a concave surface having teeth has the potential to exert a detrimental cutting force on a rope. The cutting force is simply the ratio of the weight divided by the area contacting the rope.

The present invention teaches a new, useful, and non-obvious set of crested curbs on the outside edges of the concave working surface on the cam face which engages the rope. Inside the concave surface are parallel flat ridges, each ridge having a flat top. The result is lower psi per contact point with the rope and additionally a higher total grip strength.

The ridges are uniquely positioned across the radius of the concave cam face to provide a superior grip without corresponding rope damage. The cams rounded curb margins uniquely prevent ropes from diagonal or unusual load/forces. In addition these cam crested curbs keep the rope geometrically aligned to prevent rope distortion torque and damage. Together the curb/ridges provide a higher grip at a lower PSI on the ropes.

Another advantage of the present invention is an integral safety lock which can lock the cam either open or closed. This lock can prevent accidental disengagement of a rope. This lock can also assist in the rapid and safe engagement should the user so choose.

The present invention can be used singly or in pairs. It can be mounted in rope ascenders, pulley safety locks, rope cleats or bits-marine, safety stops for workers on a rope, and fall protection devices.

SUMMARY OF THE INVENTION

The main object of the present invention is to provide a friction cam for a rope wherein the working surface of the cam is concave having a set of crested curbs and further comprises gear-like ridges, each ridge having a flat top. This design reduces the cutting force by lowering the psi per contact point and additionally increases the total grip strength.

Another object of the present invention is to provide an integral safety lock which can be set to either the open or the closed position.

Other objects of this invention will appear from the following description and appended claims, reference being had to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
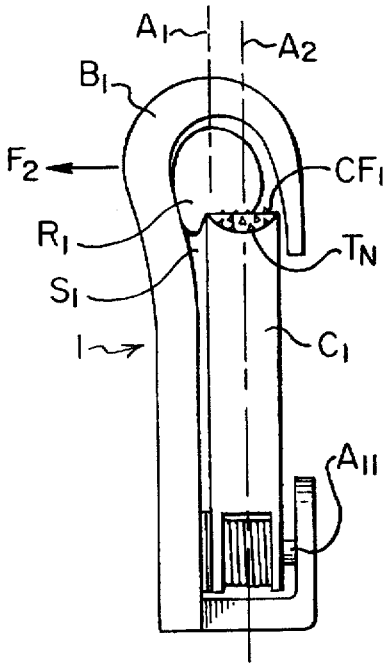
FIG. 1 (PRIOR ART)
FIG. 1 (prior art) is a top plan view of an ascender that was destroyed by an off axis force of the rope.

Referring first to FIG. 1 a known ascender 1 has a traditional cam $C_1$. The cam $C_1$ pivots about axle $A_{11}$. When a downward or ascending force $F_1$ (into the page) is put on the ascender 1, the cam $C_1$ rotates upwards out of the page and locks the rope $R_1$ against the body $B_1$. Normally the central axis $A_1$ of the rope $R_1$ is in axial alignment with the central axis $A_2$ of the cam $C_1$. However, in FIG. 1 the ascending force was so great that the rope $R_1$ slipped off the cam face $CF_1$ and exerted an off-axial force $F_2$ on the body $B_1$. The body $B_1$ failed and bent, thereby creating a space $S_1$ between the body $B_1$ and the cam $C_1$. The axis $A_1$, $A_2$ are no longer in alignment. The ascender 1 as shown has failed and jammed on the rope $R_1$. The traditional cam face $CF_1$ is concave and possesses teeth $T_N$ which grab the rope $R_1$. However, during the failure mode shown the teeth $T_N$ have scratched and permanently destroyed the rope $R_1$.

Figure 2:
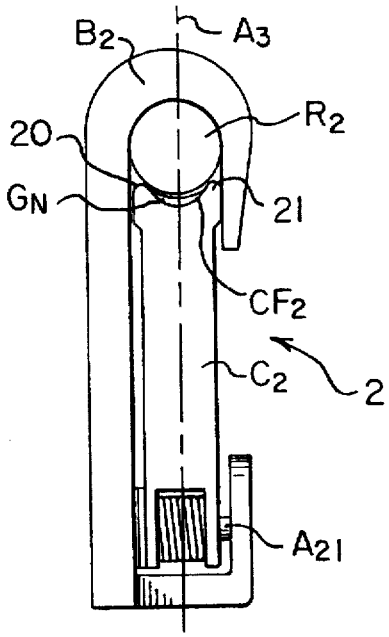
FIG. 2 is a top plan view of an ascender comprising the preferred embodiment of the ascending cam, wherein the rope was maintained in axial alignment with the ascending cam.

Referring next to FIG. 2 an ascender 2 has the preferred embodiment of the present invention shown as cam $C_2$. The rope $R_2$ is in axial alignment along axis $A_3$ with the central axis of cam $C_2$. Cam $C_2$ pivots around axle $A_{21}$. The rope $R_2$ is shown locked against body $B_2$ due to the ascending force $F_2$ imparted on ascender 2.

The unique cam face $CF_2$ is shown to be concave. Parallel ridges $G_N$ grip the rope $R_2$. See FIG. 5. Crested curbs 20, 21 extend along the lengthwise edges of the cam face $CF_2$. The crested curbs 20, 21 function to hold the rope $R_2$ in axial alignment along axis $A_3$ with the cam $C_2$.

Figures 4, 5, 6:
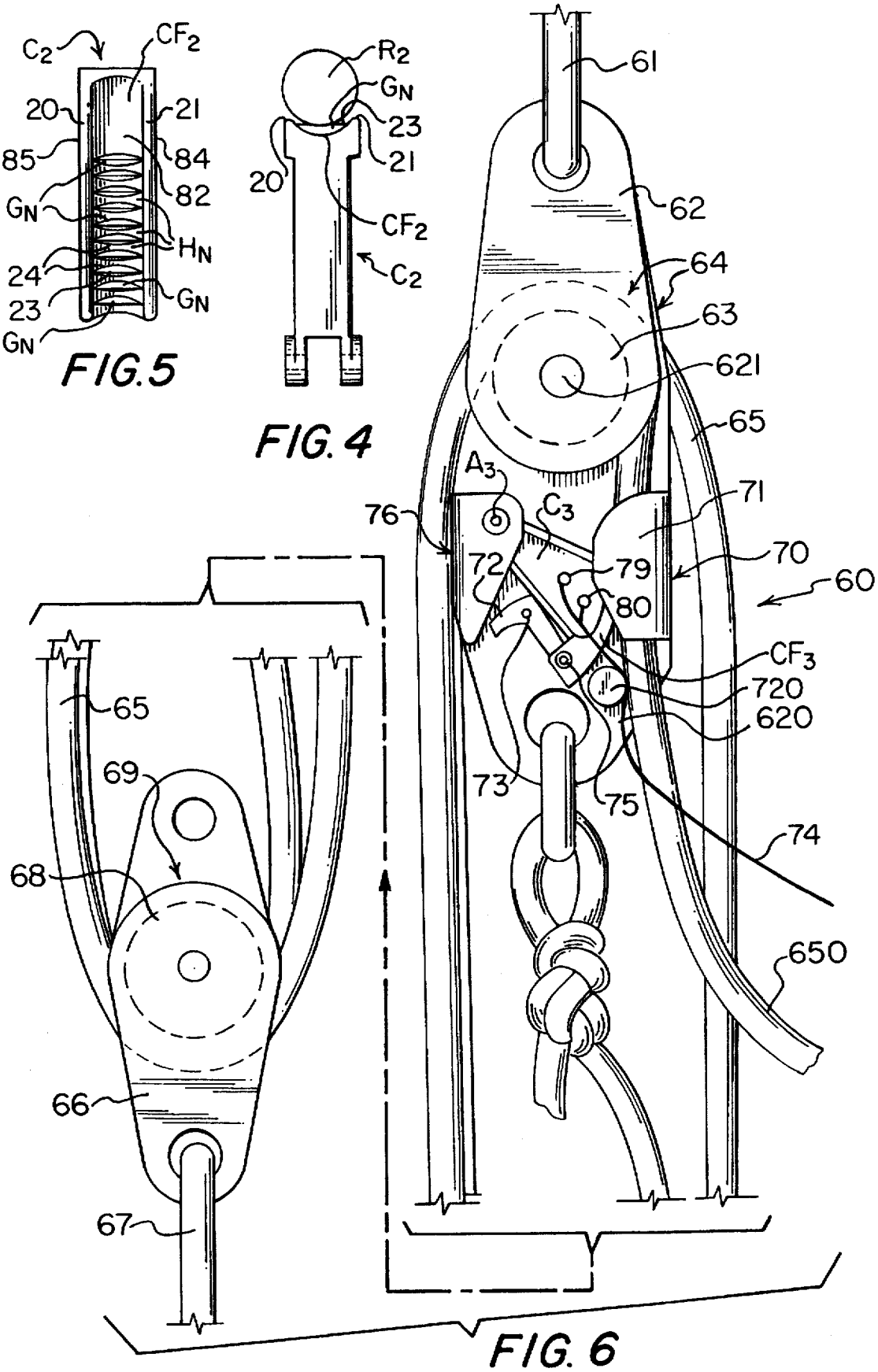
FIG. 4 is a back plan view of the cam shown in FIG. 2.
FIG. 5 is a front plan view of the cam showing the rope face. The cam is the one shown in FIG. 2.
FIG. 6 is a side plan view of a winch having the ascending cam installed therein.

Referring next to FIGS. 4, 5 the cam $C_2$ of FIG. 2 is shown dismounted. The tops of crested curbs 20, 21 are seen as rounded and not sharp. Each ridge $G_N$ tapers from its base 24 to its top surface 23. It can be seen that the top surface 23 of each ridge $G_N$ is straight. The base 24 of each ridge $G_N$ is straight. The base 24 of each ridge $G_N$ is wider than the top surface 23. The rope $R_2$ under pressure compresses into the hollows $H_N$ between each ridge $G_N$. See FIG. 5. The result is that there is provided a lower cutting force than in a cam having traditional teeth $T_N$ as shown in FIG. 1. Furthermore, an overall greater braking force is obtained than in a cam having traditional teeth $T_N$.

| Sample | Ultimate Load (LBF) | Results |
|---|---|---|
| Gold Anodized Double Block Pulley | 744 (CAM Test) | Rope Slips Thru CAM (Direct Pull) |
| | 830 (CAM Test) | Rope Slips Thru CAM (Over Sheave) |
| | 15,650 (Strength test) | Ultimate Load - Failed at Attaching Holes. |

Note:
CAM Would Not Hold 1/2" Or 3/8" Cable
During cam strength tests, slight surface fraying of outer sheath of rope occurred as rope slipped thru cam-lock. No other damage to rope or cam occurred.

Referring next to FIG. 6 a winch 60 is shown having a traditional 4:1 leverage design. In operation the user pulls the rope end 650 of rope 65. A roof mounted hook 61 supports the winch 60. The top pulley assembly 62 houses two side by side pulleys 63, 64. Pulley assembly 62 is secured to winch body 620 by bolt 621. The rope is wound around side by side pulleys 68, 69 of the load pulley assembly 66. The load is represented at 67. Pulling on crank end 650 exerts a 4:1 lifting force on load 67.

The winch 60 is fitted with a brake assembly 70. The brake assembly 70 consists of a rope wedge 71 and a rope guide 720. A cam $C_3$ pivots around axle $A_3$. Cam face $CF_3$ locks the rope 65 against the wedge 71 as shown in the locked position. The load 67 is shown suspended by the brake assembly 70.

Figure 3:
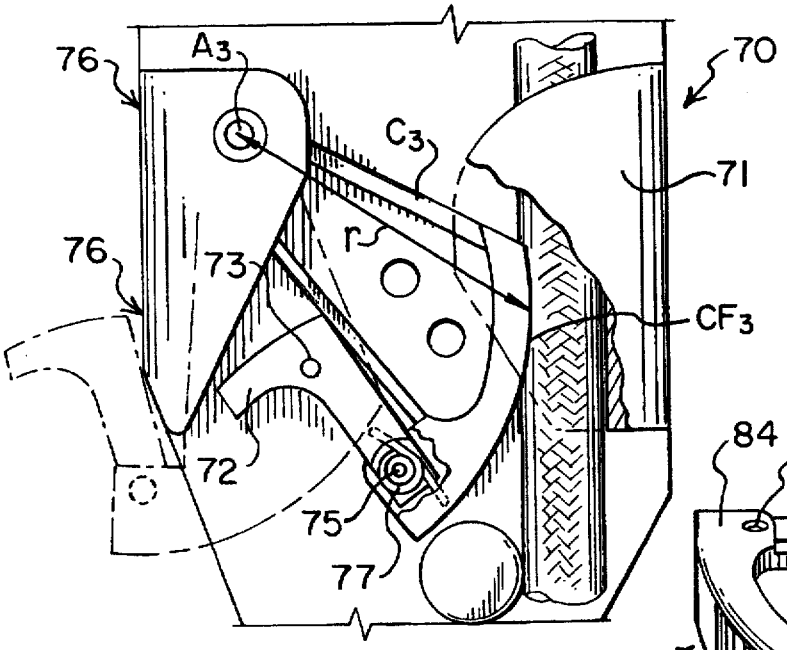
FIG. 3 is a side plan view of the cam's integral safety lock as used on the winch shown in FIG. 6.
Figure 7:
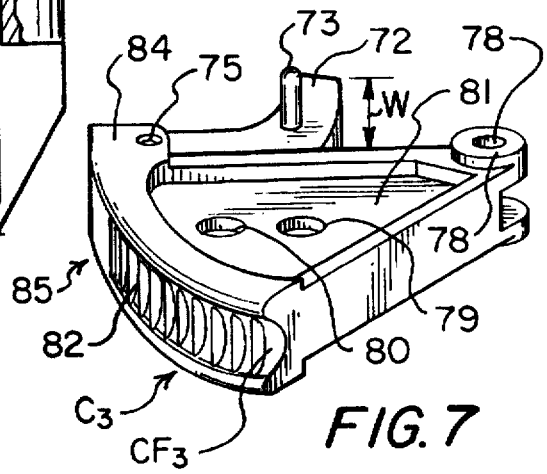
FIG. 7 is a top perspective view of the cam.

FIG. 3 shows the brake assembly 70 in a close-up view. The typical eccentric radius r of cam $C_3$ is shown. Radius r extends from axle $A_3$ to cam face $CF_3$. The safety lever 72 functions to hold the cam $C_3$ away from the rope 65 when in the OPEN position shown in dots. When in the OPEN position the safety lever 72 is spring loaded against the retaining wall 76. Retaining wall 76 has a width W approximately the same as the width W of the safety level 72 as best shown in FIG. 7. A pin 73 projects perpendicularly from the safety lever 72. The pin 73 provides easy release by fingers. Alternatively the string 74 attached to holes 79, 80 is used for remote release of safety lever 72 as shown in FIG. 6. The safety lever 72 pivots around axle 75 and is normally spring loaded against cam $C_3$ by spring 77.

Referring last to FIG. 7 the hole 78 is shown when the axle $A_3$ is disassembled. Cam body 81 is narrower than cam face $CF_3$. Cam body 81 has holes 79, 80 which can be used to remotely control the position of cam $C_3$. Cam body 81 is preferably made of a one piece investment casting having no seams or welds. The cam $C_3$ works on all types of rope including laid, braided, or plaited. The ramp 82 allows for rope friction without harm to the rope. The ramp 82 is located at the bottom bite end of the cam $C_3$. The bottom bite end of the cam $C_3$ has ears 84, 85 which support the axle 75.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A rope cam comprising:

a cam body;

a cam face on the cam body; and said cam face further comprising a concave working surface, a plurality of ridges in the working surface disposed perpendicular to a rope travel direction in the cam face, and a pair of crested curbs, one on each edge of the concave working surface running lengthwise with the working surface, functioning to maintain the rope coplanar with the cam body.

2. The cam of claim 1, wherein the cam face further comprises a bottom bite end having a smooth ramp on the cam face.

3. The cam of claim 2 further comprising a safety lever means pivotally affixed to the bottom bite end functioning to releasably mount on a fixture to hold the cam away from a rope in an OPEN position.

4. The cam of claim 3, wherein the safety lever means further comprises a spring to hold the safety lever means normally against the cam body and a pin to provide for a remote release of the safety lever means from the OPEN position.

5. The cam of claim 1, wherein the cam body further comprises a connecting means functioning to provide remote control of the position of the cam by a cord attached to the connecting means.

6. The cam of claim 1, wherein the cam body is narrower than the cam face.

7. An ascending cam comprising:

a cam body having a cam face;

said cam face further comprising a concave working surface running along a working length, a plurality of parallel ridges in the concave working surface and perpendicular to the working length, and a crested curb on each side of the concave working surface running along the working length;

said cam face further comprising a bottom bite end; and a safety lever means pivotally attached to the bottom bite end.

8. The cam of claim 7, wherein said safety lever means further comprises a spring loaded catch functioning to releasably hold the cam against a post in an OPEN position.

9. An improvement for a winch having an elongate body, a pair of pulleys at each end of the elongate body, a 4:1 leveraged rope threaded through the pulleys, said rope having a crank end, a braking assembly having a rope guide, a wedge, a retaining wall and a cam, the improvement comprising:

said cam having a concave working surface running parallel and co-planar with the rope;

said concave working surface having a pair of peripheral edges;

said concave working surface having a plurality of ridges perpendicular to the rope and a pair of crested curbs running along the peripheral edges;

said cam having a bottom bite end with a safety lever means;

said retaining wall permanently affixed to the elongate body; and means for manually latching the safety lever means to the retaining wall and means to remotely release the safety lever means therefrom, functioning to provide a brake as the rope is pressed against the wedge by the cam.

10. The improvement of claim 9, wherein the safety lever means further comprises a spring loaded latch normally pressed against the cam.

11. The improvement of claim 10, wherein the means for manually latching the safety lever further comprises a pin on the safety lever.

12. The improvement of claim 10, wherein the means to remotely release the safety lever further comprises a cord attached to a connecting means on the cam.

* * * * *